US005095958A

United States Patent [19]

Tincati

[11] Patent Number: 5,095,958

[45] Date of Patent: Mar. 17, 1992

[54] FILLER VALVE FOR BOTTLING EQUIPMENT, INCORPORATING MEANS OF SUPPORT FOR A DUMMY BOTTLE

[75] Inventor: Franco Tincati, Parma, Italy

[73] Assignee: Sarcmi S.P.A., Parma, Italy

[21] Appl. No.: 527,746

[22] Filed: May 23, 1990

[30] Foreign Application Priority Data

Jul. 21, 1989 [IT] Italy ..... 40120 A/89

[51] Int. Cl.[5] ..... B67C 3/22

[52] U.S. Cl. ..... 141/91; 141/89; 141/129

[58] Field of Search ..... 141/1, 85, 89–91, 141/129, 147, 148, 150, 151, 172, 275

[56] References Cited

U.S. PATENT DOCUMENTS

| | | | |
|---|---|---|---|
| 2,219,223 | 10/1940 | Dichter | 141/90 |
| 2,359,785 | 10/1944 | Pechy | 141/91 |
| 2,360,565 | 10/1944 | Kerr | 141/91 |
| 2,634,894 | 4/1953 | Fischer et al. | 141/91 |
| 2,718,989 | 9/1955 | Day et al. | 141/89 |
| 3,105,525 | 10/1963 | Boucher | 141/91 X |
| 3,605,827 | 9/1971 | Risser | 141/90 X |
| 3,759,303 | 9/1973 | Henrichs et al. | 141/1 |
| 4,456,037 | 6/1984 | Gocho | 141/1 |
| 4,559,961 | 12/1985 | Anderson et al. | 141/91 X |
| 4,579,156 | 4/1986 | Graffin | 141/89 |

FOREIGN PATENT DOCUMENTS

| | | | |
|---|---|---|---|
| 0722028 | 6/1942 | Fed. Rep. of Germany | 141/151 |
| 2804423 | 8/1979 | Fed. Rep. of Germany . | |
| 3722495 | 1/1989 | Fed. Rep. of Germany . | |

*Primary Examiner*—Henry J. Recla
*Assistant Examiner*—Casey Jacyna
*Attorney, Agent, or Firm*—Laff, Whitesel, Conte & Saret

[57] ABSTRACT

The art field is that of bottling equipment, and more especially, filling machinery in which each valve is fitted permanently with a dummy bottle (2) that can be positioned under the filler outlet for the purposes of sanitization, a periodic operation consisting in successive flushing cycles designed to cleanse all such internal spaces and external parts of the valve as come into contact with the bottled product, in the interests of hygiene; the flushing liquid generally used is water and soda.

16 Claims, 2 Drawing Sheets

FIG1
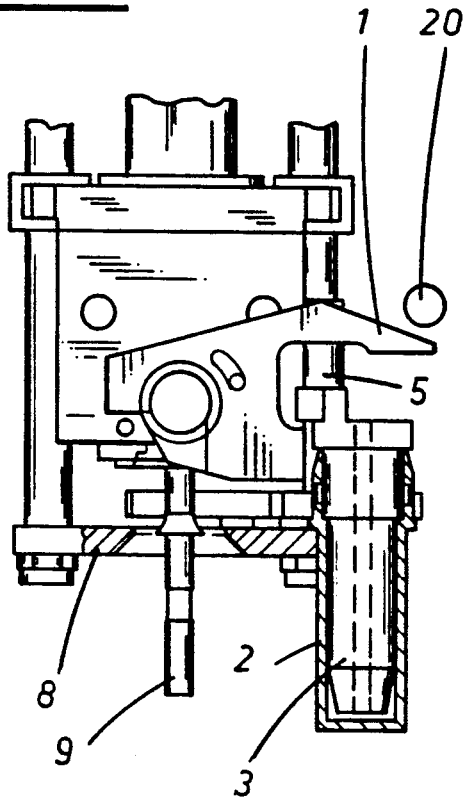
FIG3
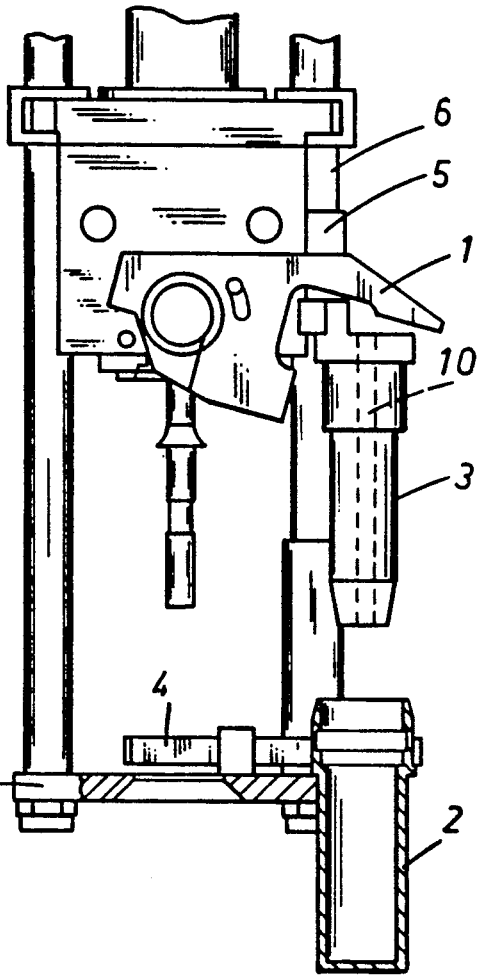
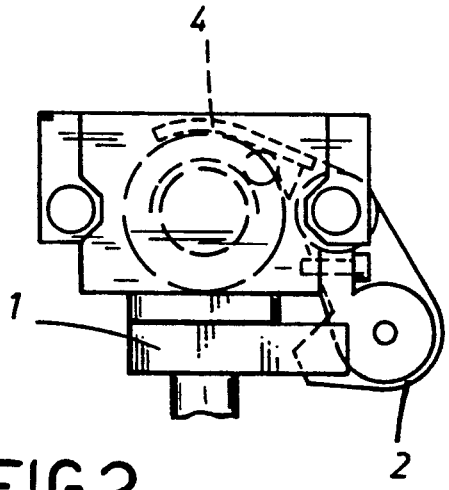
FIG2
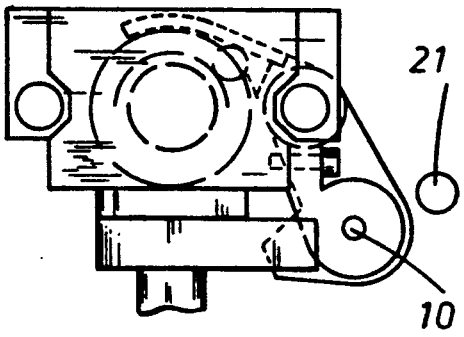
FIG 4

FIG 5
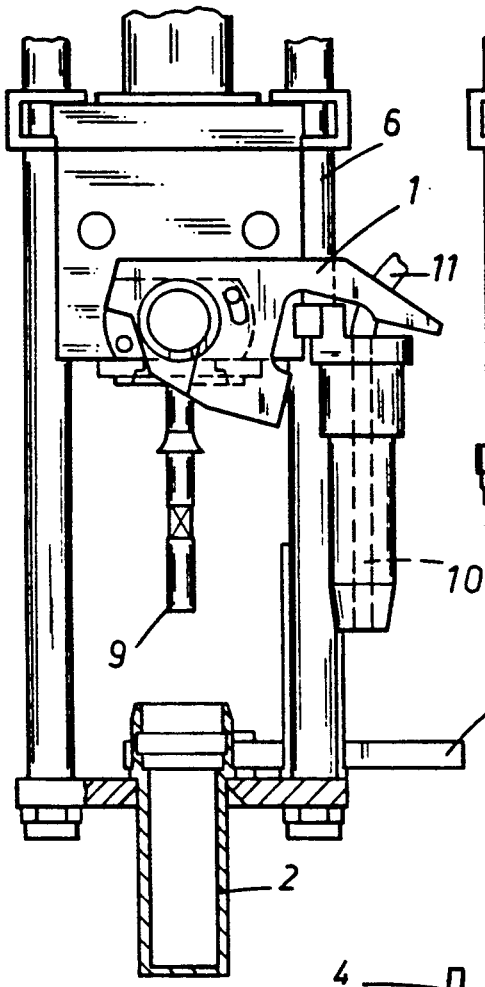
FIG 7
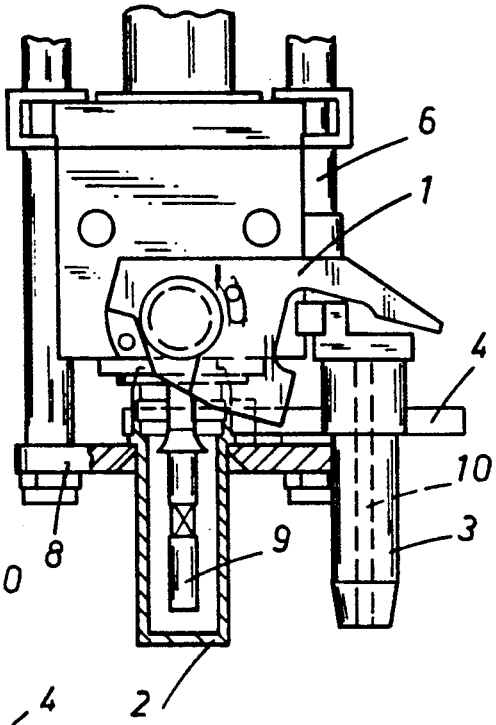
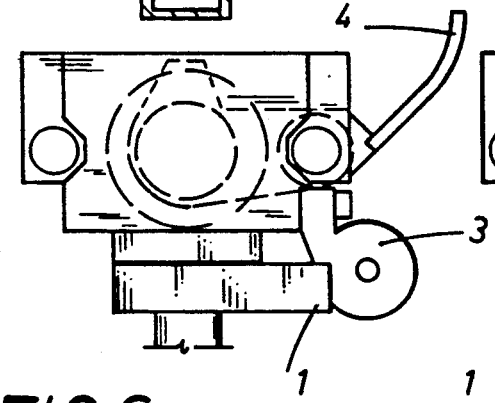
FIG 6
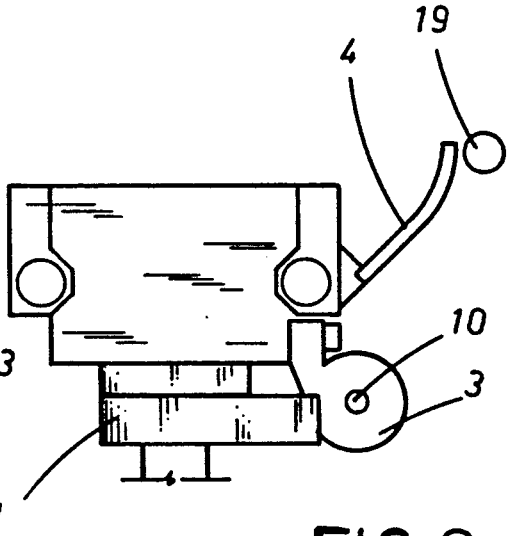
FIG 8

FILLER VALVE FOR BOTTLING EQUIPMENT, INCORPORATING MEANS OF SUPPORT FOR A DUMMY BOTTLE

BACKGROUND OF THE INVENTION

The present invention relates to a filler valve for bottling machinery, incorporating means by which to support a dummy bottle.

The prior art embraces bottle filling machines in which periodic sanitization, that is, a hygienic cleansing operation effected by repeated flushing of the filler valves and all the relative internal chambers and external parts that come into contact with the product, using water and water with soda at high temperature, involves positioning a test or dummy bottle under each valve by hand; the purpose of the dummy is to collect the flushing liquids and to simulate a production bottle, enabling execution of the various steps of the normal filling cycle. An automatic filling system also exists, whereby dummy bottles are positioned beneath the filler valves utilizing a star wheel and a belt conveyor, though the dummies still require loading initially, and removing once the sanitization procedure has been completed.

Conventional systems thus betray the drawback that each cleansing operation dictates the loss of a certain amount of time in arranging and removing dummy bottles respectively in preparation for and on completion of the sanitizing cycle. The object of the present invention is to overcome the drawback mentioned above, and in particular, when sanitization of the bottling equipment is due, to allow of positioning dummy bottles automatically under the filler valves and, on completion of the sanitizing cycle, of automatically retracting the bottles, which are associated permanently with the valve by way of support means, and returning them to a stowed position.

SUMMARY of the INVENTION

The stated object is comprehensively realized by adoption of a filler valve for bottling equipment as disclosed, which is of the type incorporating means of support for a dummy bottle and comprising a frame, associated with and axially slidable in relation to the body of the valve and designed to raise a bottle toward the valve outlet by way of a hook mechanism.

According to the invention, a dummy bottle can be associated permanently with the valve and moved into position automatically as and when required, thereby eliminating manual intervention.

BRIEF DESCRIPTION OF THE DRAWINGS

The invention will now be described in detail, by way of example, with the aid of the accompanying drawings, in which:

FIG. 1 is a frontal elevation of the filler valve body, which shows the dummy bottle in its stowed position, permanently associated with the valve;

FIG. 2 shows the filler valve body from above, in the situation of FIG. 1;

FIG. 3 is a frontal elevation of the filler valve body, showing the dummy bottle released from the stowed position and lowered along the direction of its own axis;

FIG. 4 shows the filler valve body from above, in the situation of FIG. 3;

FIG. 5 is a frontal elevation of the filler valve body, showing the dummy bottle positioned beneath and coaxial with the valve outlet;

FIG. 6 shows the situation of FIG. 5 in a view from above;

FIG. 7 is a frontal elevation of the filler valve body, showing the dummy bottle in its operative position during the sanitizing cycle, raised up against valve;

FIG. 8 shows the situation of FIG. 7 in a view from above.

DESCRIPTION OF THE PREFERRED EMBODIMENTS

With reference to the drawings, 1 denotes a cam plate operated by a shoe 20, the movement of which releases a dummy bottle 2 from its stowed position, stationed over a cylinder 3 integral with the body of the filler valve.

The cylinder 3 exhibits two sections of dissimilar diameter in order to enable its adaptation to the shape of the dummy bottle, and at the same provide a stopping and protective element for the bottle. 10 denotes a hole in the cylinder, through which a tube 11 can be inserted to the end for blowing the dummy bottle clear of residual cleansing liquids by means of compressed air.

The dummy bottle 2 is associated permanently with the body of the filler valve by way of a sleeve 5, performing the function of a guide, which ensheaths a column 6 forming part of frame that is axially slidable in relation to the valve.

21 denotes one of a plurality of pins exhibited by the bottling machine (see FIG. 4), which, with the carousel structure of the machine revolving in the direction of the arrow marked 22, are designed to strike the corresponding dummy bottle 2, causing it to rotate about its column 6 and move into coaxial alignment with the outlet 9 of the filler valve; thereafter, the dummy bottle 2 will be raised to the outlet by means of a hook element 8 (the same as that by which production bottles are raised in normal operation).

The dummy bottle is also connected rigidly to an arm 4 designed to interact with a pin 19 (FIG. 8); with the carousel revolving and the flushing operation terminated, the pin 19 strikes against the arm 4, causing the dummy bottle to rotate about the column 6 in the direction opposite to that first mentioned and return into coaxial alignment with the support cylinder 3.

FIGS. 3, 4, 5, 6, 7 and 8 illustrate the various configurations of the dummy bottle and the means by which it is associated permanently with the valve, in passing to the position assumed in readiness for the start of the sanitizing operation.

In operation of the bottling equipment, when the need arises to effect a sanitizing cycle, the cam 1 is actuated automatically by the shoe 20 to release the dummy bottle 2, which descends along its own axis and is struck by the pin denoted 21, thereupon rotating about the relative column 6 into alignment with the valve; the hook element 8 then operates to raise the dummy bottle up to the outlet 9, against which it registers hermetically in the manner of a production bottle.

Once the various steps of the sanitizing cycle have been completed, the dummy bottle will be returned to its stowed position automatically by a reversal of the steps described in the foregoing, remaining permanently associated with the valve; accordingly, one has the advantage that no manual operations are required whatever, either to position the dummy bottles in readiness for the sanitizing cycle or to remove them from the machine on completion of the cycle.

What is claimed:

1. A filler valve for bottling equipment, comprising:
a filler valve body;
a frame associated with and axially slidable in relation to the valve body, said frame being designed to raise a bottle toward the valve outlet by way of a hook element;
a dummy bottle;
means by which to support a dummy bottle;
said dummy bottle and said support means being ensheathed by said filler valve body when said dummy bottle is not being used.

2. A filler valve as in claim 1, wherein the dummy bottle is disposed parallel to the axis of the valve and is rotatable about a supporting column toward a position of coaxial alignment with the valve, on arrival at which said dummy bottle is raised up toward the valve by the hook element in the manner of a filling bottle.

3. A filler valve for bottling equipment comprising;
a filler valve body;
a frame associated with and axially slidable in relation to the valve body, said frame being designed to raise a bottle toward the valve outlet by way of a hook element;
means by which to support a dummy bottle;
a dummy bottle, permanently associated with the frame;
a cam operated by a shoe and serving to release the dummy bottle from a stowed position said dummy bottle and said support means being ensheathed by said filler valve body when said dummy bottle is not being used.

4. A filler valve as in claim 3, positioned to interact with a pin (21) by which the dummy bottle (2) is struck and caused to rotate about the supporting column (6) into the position of coaxial alignment with the valve.

5. A filler valve as in claim 4, positioned to interact with a pin (19) by which the arm (4) is struck, and the dummy bottle (2) caused to rotate about the supporting column (6) in the direction opposite to that which achieves coaxial alignment with the valve, in order to regain the position of coaxial alignment with the cylinder (3).

6. A filler valve as in claim 3, wherein means by which to support a dummy bottle comprise:
a cylinder (3) integral with the valve body;
a sleeve (5) serving to guide the movements of the dummy bottle;
an arm (4) integral with the dummy bottle, serving to position the bottle in coaxial alignment with the filler valve.

7. A filler valve as in claim 3, positioned to interact with a pin (21) by which the dummy bottle (2) is struck and caused to rotate about the supporting column (6) into the position of coaxial alignment with the valve.

8. A filler valve as in claim 3, positioned to interact with a pin (19) by which the arm (4) is struck, and the dummy bottle (2) caused to rotate about the supporting column (6) in the direction opposite to that which achieves coaxial alignment with the valve, in order to regain the position of coaxial alignment with the cylinder (3).

9. A filler valve for bottling equipment wherein means by which to support a dummy bottle comprise:
a filler valve body;
a frame associated with and axially slidable in relation to the valve body, said frame being designed to raise a bottle toward the valve outlet by way of a hook element;
means by which to support a dummy bottle;
a dummy bottle, permanently associated with the frame;
a cylinder integral with the valve body;
a sleeve serving to guide the movements of the dummy bottle;
an arm integral with the dummy bottle, serving to position the bottle in coaxial alignment with the filler valve said dummy bottle and said support means being ensheathed by said filler valve body when said dummy bottle is not being used.

10. A filler valve as in claim 9, positioned to interact with a pin (21) by which the dummy bottle (2) is struck and caused to rotate about the supporting column (6) into the position of coaxial alignment with the valve.

11. A filler valve as in claim 9, positioned to interact with a pin (19) by which the arm (4) is struck and the dummy bottle (2) caused to rotate about the supporting column (6) in the direction opposite to that which achieves coaxial alignment with the valve, in order to regain the position of coaxial alignment with the cylinder (3).

12. A filler valve for bottling equipment comprising:
a filler valve body;
a frame associated with and axially slidable in relation to the valve body, said frame being designed to raise a bottle toward the valve outlet by way of a hook element;
means by which to support a dummy bottle;
a dummy bottle, permanently associated with the frame;
said filler valve being positioned to interact with a pin by which the arm is struck, and the dummy bottle is caused to rotate about the supporting column in the direction opposite to that which achieves coaxial alignment with the valve, in order to regain the position of coaxial alignment with the cylinder said dummy bottle and said support means being ensheathed by said filler valve body when said dummy bottle is not being used.

13. A filler valve for bottling equipment, comprising:
a filler valve body;
a frame associated with and axially slidable in relation to the valve body, said frame being designed to raise a bottle toward the valve outlet by way of a hook element;
means by which to support a dummy bottle;
a dummy bottle, permanently associated with the frame, wherein the dummy bottle is disposed parallel to the axis of the valve and rotatable about a supporting column toward a position of coaxial alignment with the valve, on arrival at which said dummy bottle is raised up toward the valve by said hook element in the manner of a filling bottle;
a cam operated by a shoe and serving to release the dummy bottle from a stowed position said dummy bottle and said support means being ensheathed by said filler valve body when said dummy bottle is not being used.

14. A filler valve for bottling equipment, comprising:
a filler valve body;
a frame associated with and axially slidable in relation to the valve body, said frame being designed to raise a bottle toward the valve outlet by way of a hook element;

means by which to support a dummy bottle; said means by which to support the dummy bottle include;

a cylinder integral with the valve body;

a sleeve serving to guide the movements of the dummy bottle;

an arm integral with the dummy bottle, serving to position the bottle in coaxial alignment with the filler valve, a dummy bottle, permanently associated with the frame, wherein the dummy bottle is disposed parallel to the axis of the valve and rotatable about a supporting column toward a position of coaxial alignment with the valve, on arrival at which said dummy bottle is raised up toward the valve by said hook element in the manner of a filling bottle said dummy bottle and said support means being ensheathed by said filler valve body when said dummy bottle is not being used.

15. A filler valve for bottling equipment, comprising:

a filler valve body;

a frame associated with and axially slidable in relation to the valve body, said frame being designed to raise a bottle toward the valve outlet by way of a hook element;

means by which to support a dummy bottle;

a dummy bottle, permanently associated with the frame, wherein said dummy bottle is disposed parallel to the axis of the valve and rotatable about a supporting column toward a position of coaxial alignment with the valve, on arrival at which said dummy bottle is raised up toward the valve by said hook element in the manner of a filling bottle;

said filler valve being positioned to interact with a pin by which the dummy bottle is struck and caused to rotate about the supporting column into the position of coaxial alignment with the valve said dummy bottle and said support means being ensheathed by said filler valve body when said dummy bottle is not being used.

16. A filler valve, comprising:

a filler valve body;

a frame associated with and axially slidable in relation to the valve body, said frame being designed to raise a bottle toward the valve outlet by way of a hook element;

means by which to support a dummy bottle;

a dummy bottle, permanently associated with the frame, wherein the dummy bottle is disposed parallel to the axis of the valve and rotatable about a supporting column toward a position of coaxial alignment with the valve, on arrival at which said dummy bottle is raised up toward the valve by said hook element in the manner of a filling bottle; said filler valve being positioned to interact with a pin by which the arm is struck, and the dummy bottle is caused to rotate about the supporting column in the direction opposite to that which achieves coaxial alignment with the valve, in order to regain the position of coaxial alignment with the cylinder said dummy bottle and said support means being ensheathed by said filler valve body when said dummy bottle is not being used.

* * * * *